US011458065B2

(12) United States Patent
Ma et al.

(10) Patent No.: US 11,458,065 B2
(45) Date of Patent: Oct. 4, 2022

(54) MASSAGE MOTION DEVICE AND A MASSAGER FOR SCRATCHING HEAD

(71) Applicant: SHENZHEN BREO TECHNOLOGY CO., LTD., Guangdong (CN)

(72) Inventors: Xuejun Ma, Shenzhen (CN); Rui Li, Shenzhen (CN); Xianle Tao, Shenzhen (CN)

(73) Assignee: SHENZHEN BREO TECHNOLOGY CO., LTD., Shenzhen (CN)

( * ) Notice: Subject to any disclaimer, the term of this patent is extended or adjusted under 35 U.S.C. 154(b) by 979 days.

(21) Appl. No.: 16/095,543

(22) PCT Filed: Jan. 17, 2018

(86) PCT No.: PCT/CN2018/073028
§ 371 (c)(1),
(2) Date: Oct. 22, 2018

(87) PCT Pub. No.: WO2018/227968
PCT Pub. Date: Dec. 20, 2018

(65) Prior Publication Data

US 2021/0220212 A1 Jul. 22, 2021

(30) Foreign Application Priority Data

Jun. 16, 2017 (CN) ..... 201710459381.3

(51) Int. Cl.
*A61H 7/00* (2006.01)

(52) U.S. Cl.
CPC ..... *A61H 7/004* (2013.01); *A61H 7/007* (2013.01); *A61H 2007/009* (2013.01);
(Continued)

(58) Field of Classification Search
CPC ..... A61H 7/004; A61H 2007/009; A61H 2201/1671; A61H 2201/1678; A61H 2201/1695
See application file for complete search history.

(56) References Cited

U.S. PATENT DOCUMENTS 1,577,751 A * 3/1926 Benjamin ..... A61H 7/004 601/112
1,931,849 A * 10/1933 Matson ..... A61H 7/005 601/85

(Continued)

FOREIGN PATENT DOCUMENTS

CN 201516136 U 6/2010
CN 200920183455 U 6/2010

(Continued)

OTHER PUBLICATIONS

Japanese Office Action, 2018-557791, dated Jan. 1, 2010,4 pages.

(Continued)

*Primary Examiner* — Justine R Yu
*Assistant Examiner* — Matthew D Ziegler
(74) *Attorney, Agent, or Firm* — Andrew C. Cheng

(57) ABSTRACT

A massage motion device and a massager for scratching head, and the massage motion device includes a mounting seat and a pair of swing arm assemblies; the swing arm assemblies being mounted to the mounting seat, the swing arm assemblies includes a rotating wheel and a swing arm mechanism, the swing arm mechanisms include a swinging arm, and a connecting member rotatably connected to the swinging arm via a second rotational shaft, the connecting arm is provided with a slot matched with the second rotational shaft, the slot is disposed in a direction parallel to the (Continued)

axis of the second rotational shaft, and the length extending direction of the slot is disposed in parallel to the extending direction of the guide pin.

10 Claims, 4 Drawing Sheets

(52) U.S. Cl.
CPC ..... *A61H 2201/1671* (2013.01); *A61H 2201/1678* (2013.01); *A61H 2201/1695* (2013.01)

(56) References Cited

U.S. PATENT DOCUMENTS

| | | | | | |
|---|---|---|---|---|---|
| 5,305,738 | A * | 4/1994 | Shimizu | A61H 7/005 601/135 |
| 6,083,181 | A * | 7/2000 | Marcantoni | A61H 15/0078 601/115 |
| 6,190,339 | B1 * | 2/2001 | Imazaike | A61H 7/005 601/133 |
| 7,022,092 | B2 * | 4/2006 | Shimizu | A61H 15/00 601/100 |
| 7,207,957 | B2 * | 4/2007 | Szczepanski | A61H 15/0085 601/112 |
| 8,202,235 | B2 * | 6/2012 | Huang | A61H 7/004 601/103 |
| 9,642,769 | B2 * | 5/2017 | Ma | A61H 7/007 |
| 10,555,867 | B2 * | 2/2020 | Lin | A61H 7/002 |
| 2006/0047234 | A1 * | 3/2006 | Glucksman | A61B 17/54 601/87 |
| 2008/0262397 | A1 * | 10/2008 | Habatjou | A61H 7/001 601/93 |
| 2016/0008212 | A1 * | 1/2016 | Chen | A61H 15/0078 601/112 |

FOREIGN PATENT DOCUMENTS

| | | | | | |
|---|---|---|---|---|---|
| CN | 103470718 | A | | 12/2013 | |
| CN | 201310440020 | A | | 12/2013 | |
| CN | 201520094205 | U | | 8/2015 | |
| CN | 205041730 | U | | 2/2016 | |
| CN | 201520703957 | U | | 2/2016 | |
| CN | 205251984 | U | | 5/2016 | |
| CN | 106038158 | A | | 10/2016 | |
| CN | 107233199 | A | | 10/2017 | |
| DE | 202016101281 | U1 | | 4/2016 | |
| GB | 191310057 | A | * | 7/1914 | A61H 23/0254 |
| JP | 2011-125514 | A | | 6/2011 | |
| JP | 2011125514 | A | | 6/2011 | |
| JP | 2011172626 | A | | 9/2011 | |
| JP | 3198428 | U | | 7/2015 | |
| JP | 2015519976 | A | | 7/2015 | |
| JP | 2016104433 | A | | 6/2016 | |
| TW | M386893 | U | | 8/2010 | |
| TW | M427149 | U | | 4/2012 | |
| TW | M501846 | U | | 6/2015 | |
| TW | M538389 | U | | 3/2017 | |

OTHER PUBLICATIONS

Supplemental European Search Report, EP18788990, dated Oct. 24, 2019, 9 pages.

International Search Report and Written Opinion dated Apr. 16, 2018 for corresponding International Application No. PCT/CN2018/073028, filed Jan. 17, 2018.

* cited by examiner

MASSAGE MOTION DEVICE AND A MASSAGER FOR SCRATCHING HEAD

CROSS REFERENCE

This application is a 371 National Stage Application of International Application No. PCT/CN2018/073028, filed on Jan. 17, 2018, which claims priority of Chinese Patent Application No. 201710459381.3, filed on Jun. 16, 2017, entitled "a massage motion device and a massager for scratching head", which is hereby incorporated by reference into this application as if fully set forth herein.

TECHNICAL FIELD

The present application relates to the technical field of massager, and more particularly to a massage motion device and a massager for scratching head.

BACKGROUND

The massage action of the existing massage motion device is simulation of rotation scratch press and so on, which cannot simulate the massage action of scratching of the human hand, and the massage experience is poor.

SUMMARY

The massage motion device exists the problem that it is cannot simulate the massage action of scratching of the human hand.

A massage motion device includes: a mounting seat and a pair of swing arm assemblies oppositely disposed; each of the swing arm assemblies being mounted to the mounting seat, the swing arm assemblies each includes a rotating wheel and a swing arm mechanism, each the swing arm mechanisms includes a swinging arm connected to the mounting seat via a first rotational shaft, and a connecting member rotatably connected to the swinging arm via a second rotational shaft, and the second rotational shaft is connected to a side arm of the swinging arm, the axis of the first rotational shaft is parallel to the axis of the second rotational shaft, and a side surface of the rotating wheel is provided with a guide groove, and an arrangement path of the guide groove is annular, and the geometric center of each of the guide grooves are located in the axis of rotation of the adjacent rotating wheel at a side thereof closer to or away from another the rotating wheel, the connecting member includes a connecting arm and a guide pin connected to the connecting arm and disposed in the guide groove, the connecting arm is provided with a slot matched with the second rotational shaft, the slot is disposed in a direction parallel to the axis of the second rotational shaft, the width of the slot is matched with the diameter of the second rotational shaft, and the length extending direction of the slot is disposed in parallel to the extending direction of the guide pin;

the massage motion device includes a driving assembly for driving the rotating wheels to rotate synchronously Optionally, the slot extends along the length direction thereof to the upper side of the connecting arm and forms a semi-opening hole.

Optionally, the number of the second rotational shaft is two, and the two second rotational shafts are connected to side arms of the swinging arm oppositely disposed; the connecting arm includes a pair of connecting branch arms interval disposed, the two connecting branch arms are respectively located at two sides of the swing arm, and any one of the connecting branch arms on a sidewall thereof facing the other connecting arm is provided with the slot, and one of the slots is matched with one of the second rotational shaft.

Optionally, each of the slots are through hole structures.

Optionally, the periphery of the rotating wheel is provided with a driven gear, the driving assembly includes a driving wheel, and a driving device for driving the driving wheel to rotate, the driving wheel is located between the two rotating wheels oppositely disposed, and the driving wheel is abutted against the peripheries of the two rotating wheels, and the periphery of the driving wheel is provided with driving gear mesh with the driven gear.

Optionally, the massage motion device comprises two pairs of the swing arm assemblies, and the four swing arm assemblies are arranged in a circular array.

Optionally, the number of teeth of the driven tooth is greater than the number of teeth of the driving gear.

Optionally, the connecting member further includes a sleeved on the guide pin, and the sleeve is rotatably matched with the guide pin.

Optionally, each of the rotating wheels is connected to the mounting seat via a third rotational shaft, and the third rotational shaft is fixed to the mounting seat.

The present application further provides a massager for scratching head including the above-described massage motion device.

According to the structure of the present application, in a specific use process, the driving assembly drives the rotating wheels to rotate synchronously, wherein the guide pin placed in the guide groove moves back and forth in the guide groove in a direction perpendicular to the second rotational shaft along the rotation of the rotating wheel, while during the movement of the guide pin, the guide pin drives the connecting arm to move back and forth in a direction perpendicular to the second rotational shaft, thereby driving the swing arm to swing around the second rotational shaft, and the swing arm assemblies are arranged in pairs, the two swing arms of the pair of swing arm assemblies will swing toward or away from each other at the same time, thereby realizing the action of scratching of the human hand, so that after the massage component is mounted on the swing arm, it can obtain well massage experience.

Since the length extending direction of the slot is parallel to the extending direction of the guide pin, the interaction force between the connecting arm and the second rotational shaft are perpendicular to the wall of the length direction of the slot, thereby preventing the connecting arm from affecting form the force parallel to the extending direction of the guide pin, that is, preventing the whole connecting member from affecting form the force parallel to the extending direction of the guide pin, thereby preventing the situation the connecting member from jumping in parallel with the extending direction of the guide pin, and enhance stability.

BRIEF DESCRIPTION OF THE DRAWINGS

In order to make the technical solutions in the embodiments of the present application clearer, the accompanying drawings to be used in the embodiments and the description of the prior art will be briefly introduced below, it is apparent that the drawings in the following description are merely some embodiments of the present application and that other drawings may be obtained by those skilled in the field without departing from the inventive nature of the application.

DESCRIPTION OF THE REFERENCE NUMERALS

Figure 1:
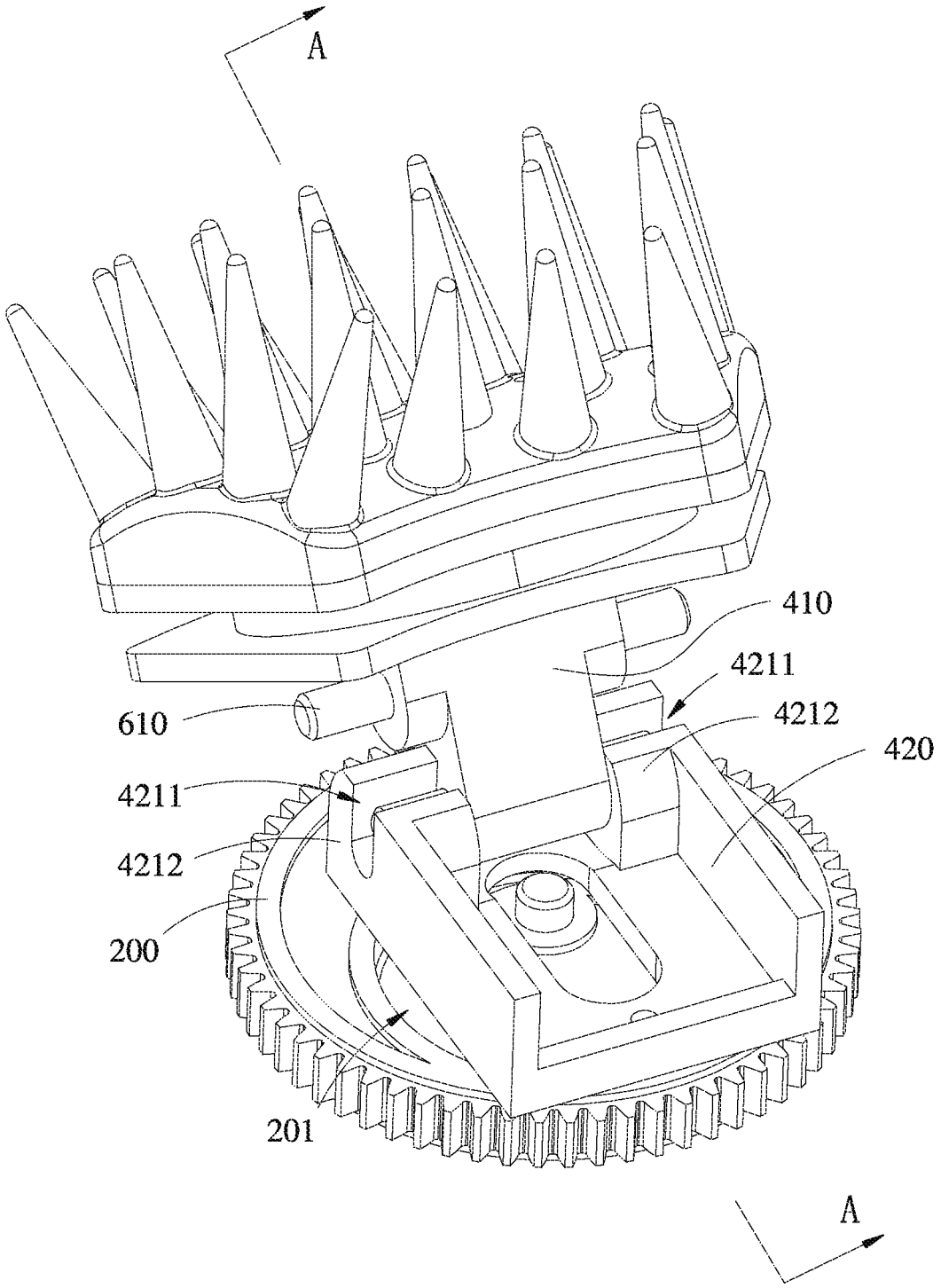
FIG. 1 is a partial schematic structure view of a massage motion device provided by an embodiment of the present application.

200 rotating wheel;
201 guide groove;
400 swing mechanism;
410 swing arm;
420 connecting member;
4211 slot;
4212 connecting branch arm;
422 guide pin;
610 first rotational shaft;
620 second rotational shaft; and
630 third rotational shaft.

DETAILED DESCRIPTION OF THE EMBODIMENTS

In order to make the technical problems to be solved, technical solutions, and beneficial effects of the present application clearer and more understandable, the present application will be further described in detail herein after with reference to the accompanying drawings and embodiments. It should be understood that the embodiments described herein are only intended to illustrate but not to limit the present application.

The present application embodiment provides a massage motion device.

Please refer to FIGS. 1 to 5, the massage motion device includes a mounting seat and a pair of swing arm assemblies oppositely disposed; each of the swing arm assemblies being mounted to the mounting seat.

wherein each of the swing arm assemblies includes a rotating wheel and a swing arm mechanism 400, the swing arm mechanisms 400 each includes a swinging arm 410 connected to the mounting seat via a first rotational shaft 610, and a connecting member 420 rotatably connected to the swinging arm 410 via a second rotational shaft 620, and the second rotational shaft 620 is connected to a side arm of the swinging arm 410, the axis of the first rotational shaft 610 is parallel to the axis of the second rotational shaft 620.

a side surface of the rotating wheel 200 is provided with a guide groove 201, and an arrangement path of the guide groove 201 is annular, and the geometric center of each of the guide grooves 210 are located in the axis of rotation of the adjacent rotating wheel 200 at a side thereof closer to or away from another the rotating wheel 200, the connecting member 420 includes a connecting arm 421 and a guide pin 422 connected to the connecting arm 421 and disposed in the guide groove 201, the connecting arm 421 is provided with a slot 4211 matched with the second rotational shaft 620, the slot 4211 is disposed in a direction parallel to the axis of the second rotational shaft 620, the width of the slot 4211 is matched with the diameter of the second rotational shaft 620, and the length extending direction of the slot 4211 is disposed in parallel to the extending direction of the guide pin 422. wherein since the geometric center of each of the guide grooves 210 are located in the axis of rotation of the adjacent rotating wheel 200 at a side thereof closer to or away from another the rotating wheel 200, in this way, the two rotating wheels 200 can drive the two guide pins 422 move toward or away from each other during the synchronous rotation; in the embodiment of the present application, the arrangement path of the guide grooves 201 is annular, and the center of the annular is offset from the rotational axis of the rotating wheel 200. And since the length extending direction of the slot 4211 is parallel to the extending direction of the guide pin 422, the interaction force between the connecting arm 421 and the second rotational shaft 620 are perpendicular to the wall of the length direction of the slot 4211, thereby preventing the connecting arm 421 from affecting form the force parallel to the extending direction of the guide pin 422, that is, preventing the whole connecting member 420 from affecting form the force parallel to the extending direction of the guide pin 422, thereby preventing the situation the connecting member 420 from jumping in parallel with the extending direction of the guide pin 422, and enhance stability.

In the above, since the first rotational shaft 610 is stationary and the connecting arm 421 can only move linearly, the moving path of the connecting arm 421 is perpendicular to the first rotational shaft, so that a connection point between the connecting arm 421 and the swing arm 410 vary with the movement of the connecting arm 421, and the swing arm 410 is connected to the second rotational shaft 620 by provided the slot 4211, ensuring that the swing arm 410 can swing normally.

Figure 2:
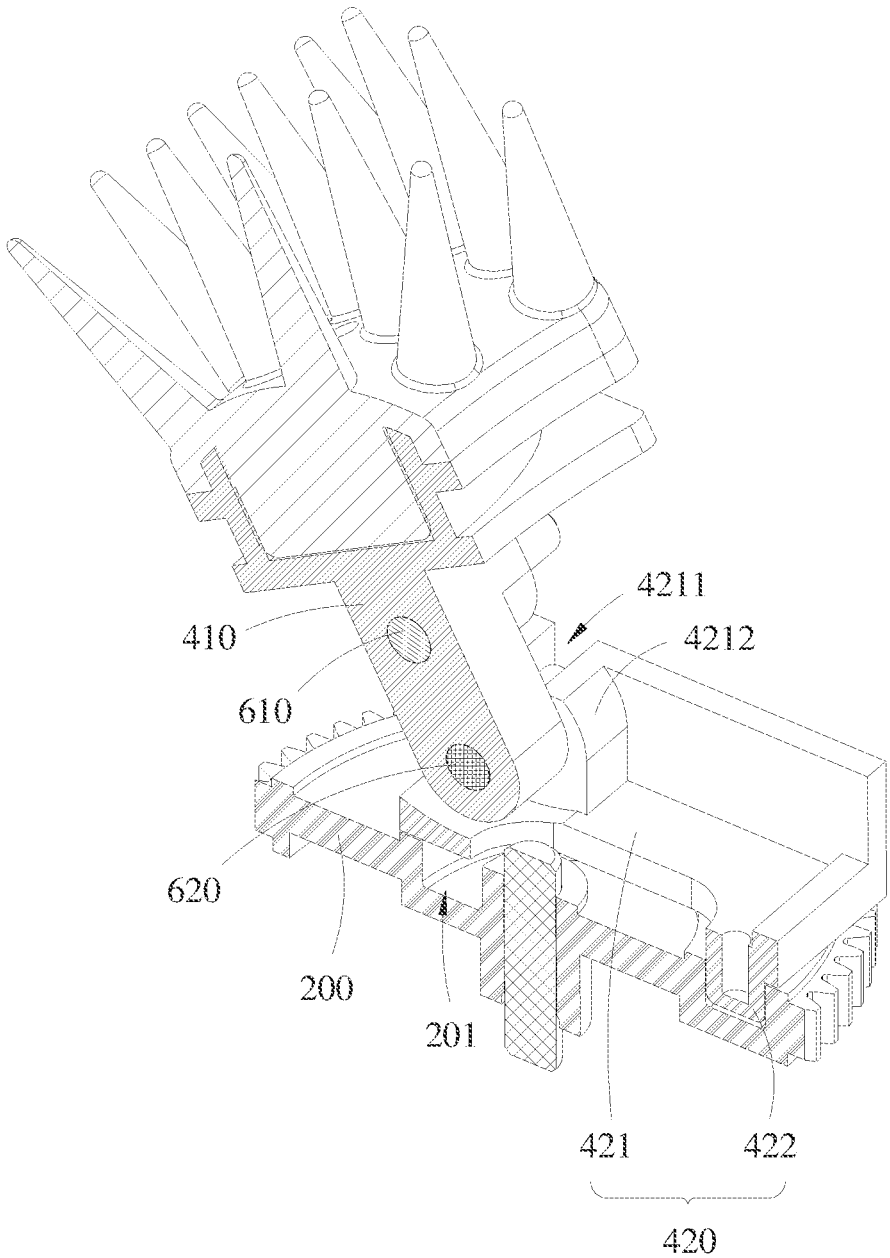
FIG. 2 is a cross-sectional view of FIG. 1 in an AA direction.
Figure 3:
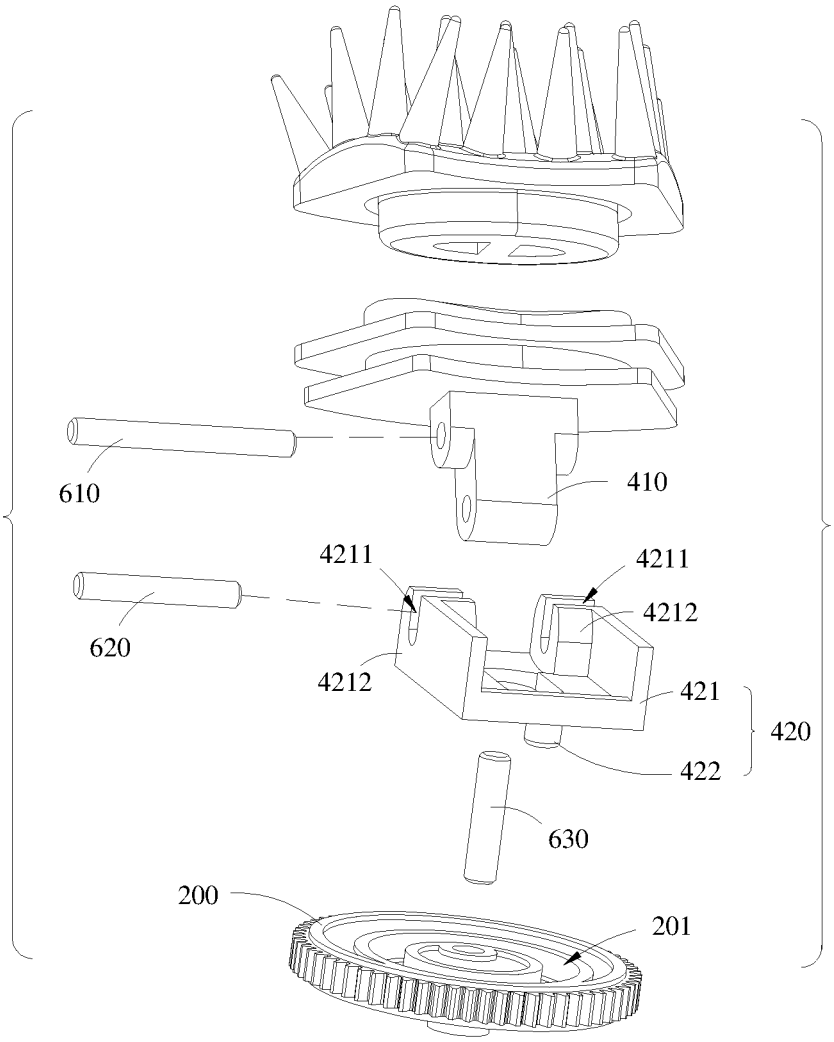
FIG. 3 is an exploded view of FIG. 1.
Figure 4:
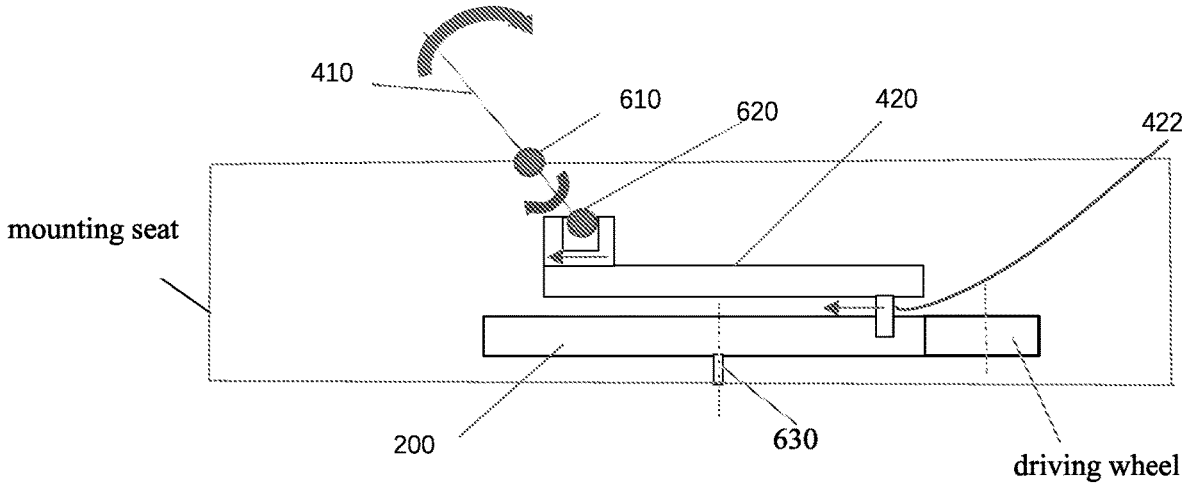
FIG. 4 illustrates the first rotational shaft connected to a mounting seat and the third rotational shaft connected to the mounting seat.
Figure 5:
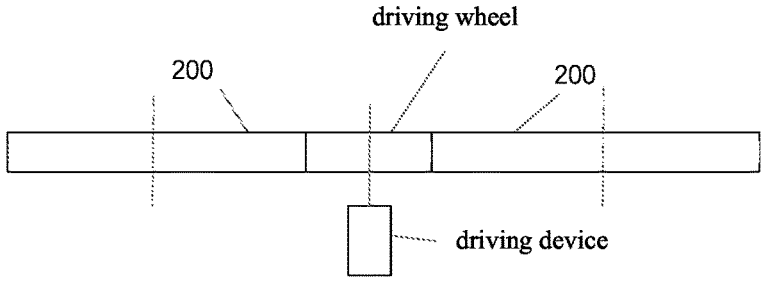
FIG. 5 illustrates the driving wheel meshed with the rotating wheel and the driving device of the driving assembly.

Please continuing refer to FIG. 1 to FIG. 3, in the embodiment of the present application, the massage motion device includes a driving assembly for driving the rotating wheels 200 to rotate synchronously.

According to the structure of the present application, since the extending direction of the guide pin 422 is perpendicular to the direction of the first rotational shaft 610, the guide pin 422 can only move in a direction perpendicular to the first rotational shaft 610, and also because the geometric center of each of the guide grooves 201 are located in the axis of rotation of the adjacent rotating wheel 200 at a side thereof closer to or away from another the rotating wheel 200, and the distance from the position where the guide pin 422 matched with the guide groove 201 to the rotational axis of the rotating wheel 200 will vary with the rotation of the rotating wheel 200.

In a specific use process, the driving assembly drives the rotating wheels 200 to rotate synchronously, wherein the guide pin 422 placed in the guide groove 201 moves back and forth in the guide groove 201 in a direction perpendicular to the second rotational shaft 620 along the rotation of the rotating wheel 200, while during the movement of the guide pin 422, the guide pin 422 drives the connecting arm 421 to move back and forth in a direction perpendicular to the second rotational shaft 620, thereby driving the swing arm 410 to swing around the second rotational shaft 620, and the swing arm assemblies are arranged in pairs, the two swing arms 410 of the pair of swing arm assemblies will swing toward or away from each other at the same time, thereby realizing the action of scratching of the human hand, so that after the massage component is mounted on the swing arm 410, it can obtain well massage experience.

In addition, it should be emphasized here that if the swing arm 410 is directly connected to the rotating wheel 200, since the moving path of the connecting point of the swing arm 410 and the connecting arm 421 is an arc during the swinging of the swing arm 410, and appears a case of moving up and down, in this way, the arrangement path of the guide groove 201 needs to match with the swing arm 410, so that the arrangement path of the guide groove 201 is not in one plane, which results in the shape of the guide groove 201 being very complicated, which is inconvenient to manufacture and greatly increases the cost; while in the embodiment of the present application, the swing arm 410 is ganged with the rotating wheel 200 via the connecting member 420, and the slot 4211 is formed in the swing arm 410. Thus, the arrangement path of the guide groove 201 can be in a plane, the shape and configuration of the guide groove 201 is greatly simplified, which is convenient for manufacturing and greatly reduces the cost.

Specifically, in the embodiment of the present application, the cross section of the guide groove 201 on the rotating wheel 200 can be rectangular.

Please refer to the figures, the slot 4211 extends along the length direction to the upper side of the connecting arm 421, and forms a semi-opening hole. In this way, it is advantageous to improve the assembly efficiency between the connecting member 420 and the swing arm 410. Specifically, in the assembly process, the second rotational shaft 620 is simply inserted into the slot 4211 from the upper side of the connecting arm 421 to complete the assembly.

Please refer to the figures, the number of the second rotational shaft 620 is two, and the two second rotational shafts 620 are connected to side arms of the swinging arm 410 oppositely disposed; the connecting arm 421 includes a pair of connecting branch arms 4212 interval disposed, the two connecting branch arms 4212 are respectively located at two sides of the swing arm 410, and any one of the connecting branch arms 4212 on a sidewall thereof facing the other connecting arm 421 is provided with the slot 4211, and one of the slots 4211 is matched with one of the second rotational shaft 620. Thus, the connection support point between the swing arm 410 and the connecting arm 421 is increased, and the connection strength between the swing arm 410 and the connecting arm 421 is enhanced. In the present embodiment, the two second rotational shafts 620 are integrally formed and pass through the swing arm 410.

Further, each of the slots 4211 are through hole structures. In this way, it is convenient to observe whether the second rotational shaft 620 and the slot 4211 are assembled well during the assembly of the connecting member 420 and the swing arm 410, which is advantageous for improving assembly efficiency.

Please refer to the figures, the periphery of the rotating wheel 200 is provided with driven gear, the driving assembly includes a driving wheel, and a driving device for driving the driving wheel to rotate, the driving wheel is located between the two rotating wheels 200 oppositely disposed, and the driving wheel is abutted against the peripheries of the two rotating wheels 200, and the periphery of the driving wheel is provided with driving gear mesh with the driven gear. Based on this design, only one driving wheel is needed, so that only one driving device for driving the driving wheel to rotate is needed, and it is not necessary to separately set the driving wheel and the driving device for each set of swing arm assemblies, thus reducing the driving source and beneficial to reduce manufacturing costs. Specifically, in the embodiment of the present application, the driving device is a driving motor.

In an embodiment of the present application, the massage motion device comprises two pairs of swing arm assemblies, the four swing arm assemblies being arranged in a circular array. Wherein, the added pair of swing arm assemblies also share the same driving wheel with another pair of swing arm assemblies.

Please refer to the figures, the number of teeth of the driven gear is greater than the number of teeth of the driving gear. Since the number of teeth of the driven gear is greater than the number of teeth of the driving gear, that is, when the driving gear rotates one round, the driven gear has not been rotated enough one round, thus the transmission ratio of the transmission component is improved, and the output torque of the driving device can be improved. Specifically, in the present embodiment, the ratio of the number of teeth of the driven gear to the number of teeth of the driving gear is 2:1.

Please refer to FIGS. 1 to 3, the connecting member 420 further includes a sleeve that is sleeved on the guide pin 422, and the sleeve is rotatably matched with the guide pin 422. Based on this structure, the guide pin 422 is in contact with the groove wall of the guide groove 201 via the sleeve, wherein since the sleeve is rotatably matched with the guide pin 422, so that when the outer side of the guide pin 422 and the groove wall of the guide groove 201 have a larger frictional resistance, the sleeve can be rotated relative to the guide pin 422, and the frictional resistance between the outer side of the guide pin 422 and the groove wall of the guide groove 201 can be prevented from being unable to slide in the guide groove 201.

Please refer to FIG. 1 to FIG. 3, each of the rotating wheels 200 is connected to the mounting seat via a third rotational shaft 630, and the third rotational shaft 630 is fixed to the mounting seat.

Please refer to FIG. 1 to FIG. 3, the massage motion device further includes at least two massage components (not shown), and each of the swing arms 410 is connected with one massage component. In this way, after the assembly of the massage motion device is completed, there is no need to additionally assemble the massage component.

The present application further provides a massager for scratching head, which includes the massage motion device, and the specific structure of the massage motion device is referred to the above embodiment. Since the massager for scratching head adopts all the technical solutions of all the above embodiments, Therefore, all the beneficial effects brought about by the technical solutions of the above embodiments are not repeated here.

The above are only the preferred embodiments of the present application, and are not intended to limit the present application. Any modifications, equivalent substitutions or improvements made within the spirit and principles of the present application are included in the scope of the present application.

What is claimed is:

1. A massage motion device, comprising:

a pair of swing arm assemblies oppositely disposed; each of the swing arm assemblies configured to be mounted to a mounting seat, each of the swing arm assemblies comprises a rotating wheel and a swing arm mechanism, and a driving assembly;

wherein each of the swing arm mechanisms comprises a swinging arm, a first stationary shaft extending through the swinging arm, a second rotational shaft, and a connecting member rotatably connected to the swinging arm via the second rotational shaft;

wherein the swinging arm comprises a base portion and a top portion located at two sides of the first stationary shaft, and the second rotational shaft is mounted at the base portion of the swinging arm;

an axis of the first stationary shaft is parallel to an axis of the second rotational shaft, and an upper surface of the rotating wheel is provided with a guide groove, and an arrangement path of the guide groove is annular, and the geometric center of each of the guide grooves is offset from a rotational axis of the rotating wheel, and the connecting member comprises a connecting arm and a guide pin connected to the connecting arm and disposed in the guide groove, and a slot disposed on the connecting arm and configured to match with the second rotational shaft, the slot defines a pair of inner wall portions disposed opposite to each other and configured to be in contact with the second rotational shaft; the pair of inner wall portions extend in a first direction parallel to the axis of the second rotational shaft, and extend in a second direction parallel to an extending direction of the guide pin; and the driving assembly is configured for driving the rotating wheels to rotate synchronously.

2. The massage motion device of claim 1, wherein the slot extends along the second direction to an upper side of the connecting arm and forms a semi-opening thereon.

3. The massage motion device of claim 1, wherein the connecting arm comprises a pair of connecting branch arms disposed apart from each other, the two connecting branch arms are respectively located at two sides of the swing arm along the axis of the second rotational shaft, and each of the connecting branch arms is provided with the slot.

4. The massage motion device of claim 3, wherein each of the slots is a through groove configured for the second rotational shaft passing through.

5. The massage motion device of claim 1, wherein the periphery of the rotating wheel is provided with driven teeth, the driving assembly comprises a driving wheel, and a driving device configured for driving the driving wheel to rotate, the driving wheel is located between the two oppositely disposed rotating wheels, and the driving wheel is abutted against the peripheries of the two rotating wheels, and the periphery of the driving wheel is provided with driving teeth to mesh with the driven teeth.

6. The massage motion device of claim 5, wherein the massage motion device comprises two pairs of the swing arm assemblies, and the four swing arm assemblies are arranged in a circular array.

7. The massage motion device of claim 5, wherein a number of teeth of the driven teeth is greater than a number of teeth of the driving teeth.

8. The massage motion device of claim 1, wherein the connecting member further comprises a sleeve sleeved on the guide pin, and the sleeve is rotatably matched with the guide pin.

9. The massage motion device of claim 1, wherein each of the rotating wheels is configured to be connected to the mounting seat via a third shaft, and the third shaft is configured to be fixed to the mounting seat.

10. A massager for scratching the head of a user, comprising: the massage motion device according to claim 1.

* * * * *